US008881486B2

(12) United States Patent
Robinson

(10) Patent No.: US 8,881,486 B2
(45) Date of Patent: Nov. 11, 2014

(54) TRUSS SADDLE APPARATUS AND METHOD

(71) Applicant: BlueScope Buildings North America, Inc., Kansas City, MO (US)

(72) Inventor: Clifford M. Robinson, Blue Springs, MO (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 13/900,229

(22) Filed: May 22, 2013

(65) Prior Publication Data

US 2013/0312361 A1 Nov. 28, 2013

Related U.S. Application Data

(60) Provisional application No. 61/650,441, filed on May 22, 2012.

(51) Int. Cl.
*E04C 3/04* (2006.01)
*E04C 3/02* (2006.01)

(52) U.S. Cl.
CPC ..... *E04C 3/02* (2013.01)
USPC ..... 52/694; 52/692

(58) Field of Classification Search
USPC ..... 52/690, 692–696
See application file for complete search history.

(56) References Cited

U.S. PATENT DOCUMENTS

| | | | | | |
|---|---|---|---|---|---|
| 1,865,059 | A * | 6/1932 | Ragsdale | ..... | 52/691 |
| 1,866,583 | A * | 7/1932 | Spencer | ..... | 52/694 |
| 2,146,540 | A * | 2/1939 | Burke et al. | ..... | 52/693 |
| 2,284,898 | A * | 6/1942 | Hartman | ..... | 52/654.1 |
| 2,966,242 | A * | 12/1960 | Kaiser | ..... | 52/376 |
| 3,344,571 | A * | 10/1967 | Day, Jr. | ..... | 52/376 |
| 3,800,490 | A * | 4/1974 | Conte | ..... | 52/250 |
| 3,946,532 | A | 3/1976 | Gilb | | |
| 4,030,264 | A | 6/1977 | Jackson | | |
| 4,050,210 | A * | 9/1977 | Gilb | ..... | 52/639 |
| 4,077,176 | A | 3/1978 | Bauer | | |
| 5,013,391 | A | 5/1991 | Hutter, III et al. | | |
| 6,758,022 | B1 * | 7/2004 | Coll et al. | ..... | 52/690 |
| 6,799,406 | B2 * | 10/2004 | Gosselin et al. | ..... | 52/694 |
| 6,892,502 | B1 * | 5/2005 | Hubbell et al. | ..... | 52/633 |
| 6,986,230 | B2 * | 1/2006 | Schipani et al. | ..... | 52/694 |
| 2007/0193186 | A1 * | 8/2007 | Callahan | ..... | 52/653.1 |

FOREIGN PATENT DOCUMENTS

| | | |
|---|---|---|
| WO | 9222716 | 12/1992 |

* cited by examiner

*Primary Examiner* — Elizabeth A Plummer
(74) *Attorney, Agent, or Firm* — Lathrop & Gage LLP

(57) ABSTRACT

Disclosed is a truss, having an upper and lower chord member each extending in generally the same longitudinal direction and in spaced apart relation. The truss also includes a plurality of web members each with a first and second end, the web members including a crimped portion at the first and second end with openings, wherein the first and second ends and openings of adjacent web members overlap. A lower chord fastening system extends through the lower chord and through the overlapping openings in the first ends of adjacent web members. An upper chord fastening system extends through the upper chord and through the overlapping openings in the second ends of two adjacent web members. The upper and lower chord fastening system further includes a saddle member extending over the web-chord junction and secured to the chords to provide additional strength to select connections at opposing ends of the truss.

11 Claims, 6 Drawing Sheets

TRUSS SADDLE APPARATUS AND METHOD

RELATED APPLICATION

This application claims the benefit of priority to U.S. Provisional Application No. 61/650,441 filed on May 22, 2012.

FIELD OF THE INVENTION

This disclosure relates generally to the design and fabrication of trusses adapted for use in modular buildings and similar environments. More specifically, this disclosure concerns the simplification of the truss manufacturing process employing a fastening system for the truss chords and web members.

Trusses allow the construction of buildings without the utilization of interior columns or reduce the need for columns to spans that can approach 60 feet. For those seeking a building such as a warehouse or a big-box retail facility the use of trusses offer tremendous flexibility with maximizing floor space without interruption by columns.

Trusses can be constructed which have spaced apart chords and rigid interconnected web members. Such trusses are generally made for specific installations and are fabricated from components which are typically welded together and then the assembled truss is submerged in large tanks of primer and paint to fully cover the entire truss thereby protecting the truss and in particular, the welded joints against corrosion. Because trusses are critical structural members supporting considerable loads, their assembly at the weld points must satisfy demanding industry standards. Skilled welders with specialized certifications must be utilized to maintain the quality and the integrity of the welds in order to produce a product that meets and exceeds these industry standards.

Standard high strength steel is typically employed in the manufacture of the truss. As previously noted, once the welds are completed and the truss is fully assembled the entire truss is either submerged in a paint bath or painted utilizing a spray gun. Both operations require specialized equipment that increases the time and the cost of production of the trusses. Alternatively, galvanized steel elements could be used to fabricate a welded truss; however, the galvanizing must first be removed from the area to be welded. Once the galvanizing is removed and the truss elements are welded the weld point is unprotected against the corrosive effects of the environment. To protect the weld areas against corrosion the truss welds must be painted thereby defeating the purpose of using galvanized steel truss components.

For the foregoing reasons, there is a need for a truss assembly process that does not require painting of the entire truss prior to shipment.

For the foregoing reasons, there is a need for a truss assembly process that does not require specialized welding expertise to secure the web members to the upper and lower chords of the truss.

For the foregoing reasons, there is a need for a galvanized, pre-coated or pre-painted steel truss that when assembled does not require grinding of the weld area to remove surface protectants prior to assembly of the truss members.

For the foregoing reasons, there is a need for a truss that can be assembled using mechanical elements that provides a load capacity comparable to a similarly sized welded truss but at a lower overall cost.

SUMMARY

The present disclosure is directed to a truss, having an upper and lower chord member each extending in generally the same longitudinal direction and in spaced apart relation. The truss also includes a plurality of web members each with a first end a second end, the web members including a crimped portion at the first end and the second end with openings disposed therein, wherein the first and second ends and openings of adjacent web members overlap. A lower chord fastening system extends through the lower chord and through the overlapping openings in the first ends of adjacent web members. An upper chord fastening system extends through the upper chord and through the overlapping openings in the second ends of the two adjacent web members, wherein a plurality of lower and upper chord fastening systems are utilized across the entire length of the truss.

Various objects, features, aspects and advantages of the inventive subject matter will become more apparent from the following detailed description of preferred embodiments, along with the accompanying drawings in which like numerals represent like components.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION

Embodiments of the present invention provide systems and a method for a truss used in fabricating structures, e.g., metal buildings. One embodiment can be seen in FIGS. 1-8.

Figure 1:
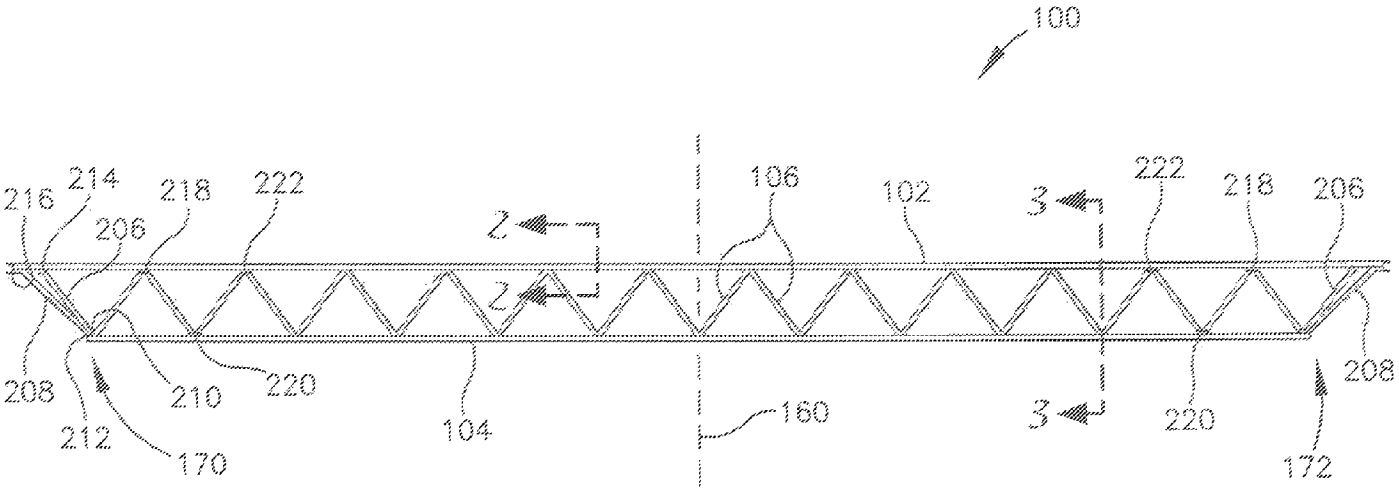
FIG. 1 is a side view of the truss.

Referring first to FIG. 1, disclosed is a truss 100 useful for a variety of purposes, e.g., constructing buildings, bridges and other structures. The embodiment disclosed comprises both an upper chord 102 and a lower chord 104 and a web 106 between the two chords 102 and 104.

Figure 2:
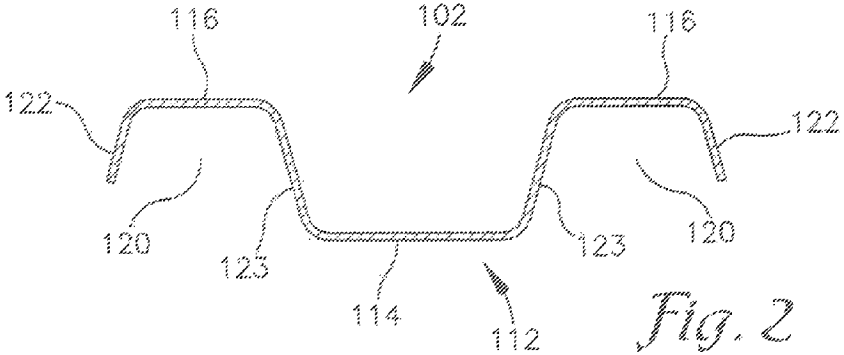
FIG. 2 is a cross-sectional view of the upper chord component of the truss taken at Section 2-2 in FIG. 1.

Upper chord 102 has an inverted-hat-shaped cross section 112, as can be seen in FIG. 2 (taken at Section 2-2 as seen in FIG. 1). Cross section 112 includes a leveled-out bottom 114, and side flanges 116 which together with bottom 114 form an upwardly facing central channel area 116. A pair of laterally-outward, downwardly-facing channel areas 120 are formed underneath the chord 102 between two downwardly (and slightly outwardly) extending edges 122.

Figure 3:
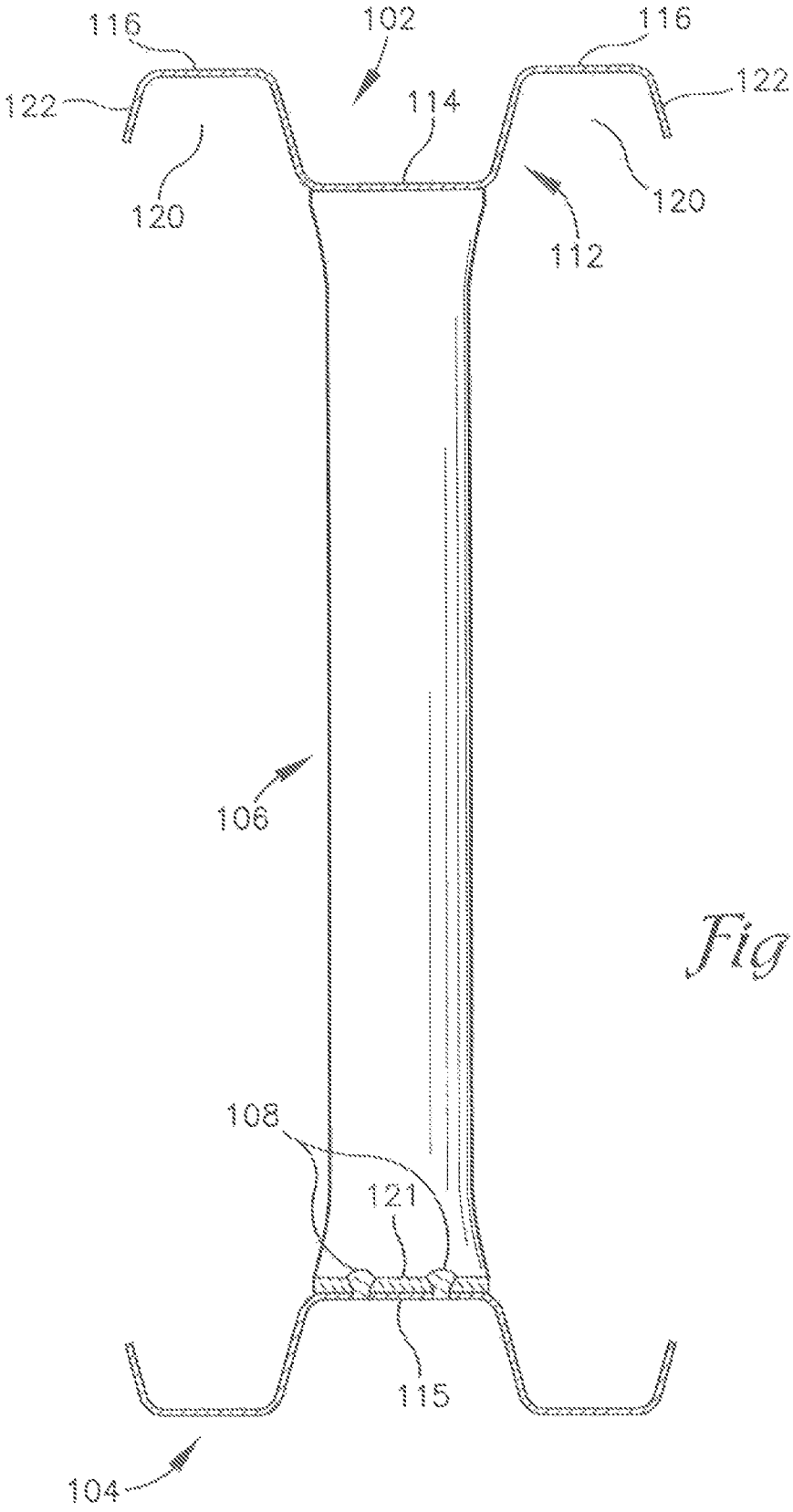
FIG. 3 is a cross-section of the entire truss taken at Section 3-3 in FIG. 1.
Figure 4:
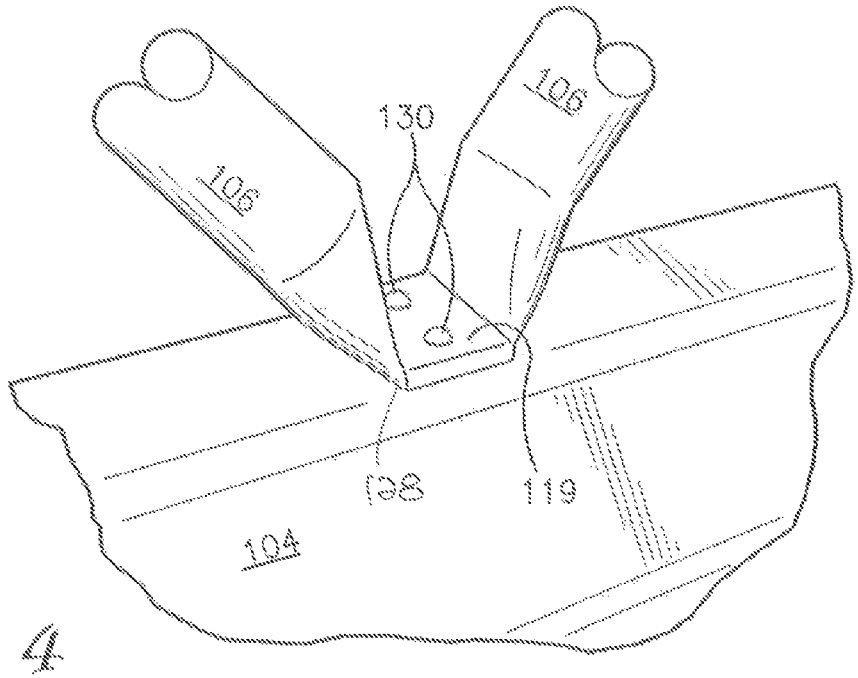
FIG. 4 is perspective view of a riveted arrangement at a junction between the webbing and chord where either (i) there is no saddle intended, or (ii) a saddle has not yet been installed.

As can be seen in the cross-section of FIG. 3 (taken from Section 3-3 in FIG. 1), the lower chord 104 is an inverted version of the upper chord 102. The chords 102 and 104 are physically connected to each other by the web 106 such that the web 106 creates a number of upward and downward V's 126.

Web 106 is tubular and meets up with and is fastened to each chord at a plurality of junctions 128. At each of these junctions 128, the webbing is bent and flattened out for a short length at portion 119. This flattened out portion 119 can be seen in cross section in area 121 in FIG. 3. This flattened-out portion 119 facilitates the installation of at least one rivet, and preferably more than one rivet connection 130 at each junction 128. In one embodiment self-piercing rivets 108 are utilized. In some embodiments the self-piercing junction rivets 108 are Henrob® rivets. The rivets are driven through the flattened out portions 119 of the webbing and penetrate the upper 102 and lower 104 chords. More specifically, the junction rivets 108 are received into the bottom 114 of the upper chord 102, and the top 115 of the lower chord 104. They are installed side-by-side, crosswise relative to webbing (see FIG. 4). Those skilled in the art will recognize that self-tapping rivets can be driven through metal without drilling holes through the flattened out portion 119 and/or the flange bottoms 114 or tops 115. In alternative arrangements, however, predrilled holes could be used to receive and secure more traditional rivets. Additionally, other kinds of fasteners, e.g., self-tapping screws, bolts, could be used to accomplish the same fastening objectives.

Figure 5:
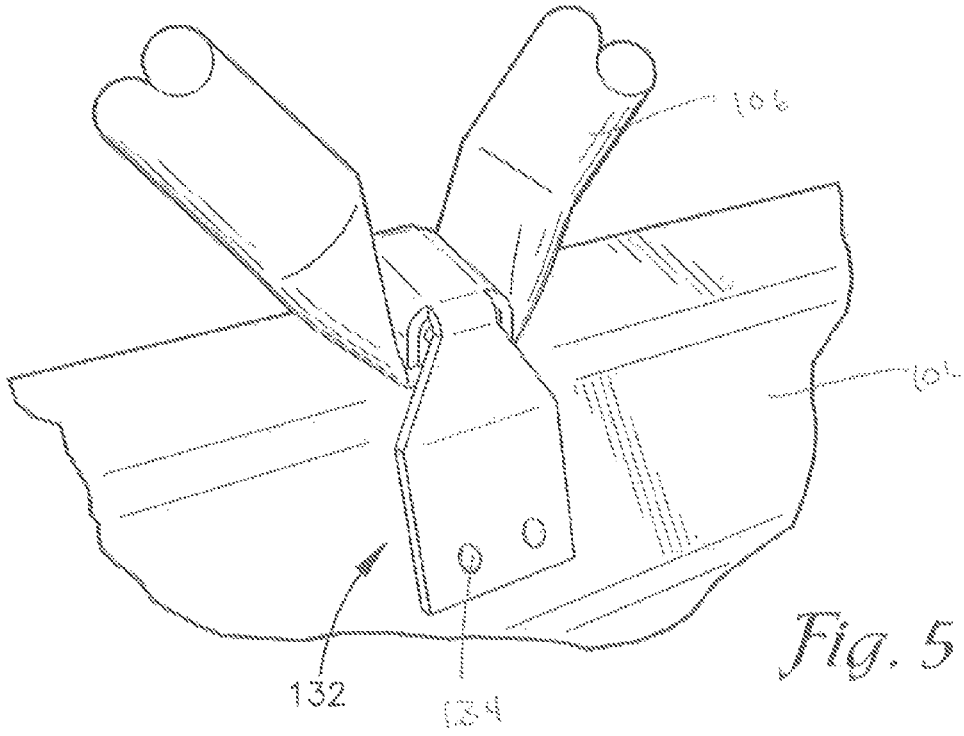
FIG. 5 is a perspective view showing a junction where a saddle has been installed.

As can be seen in FIG. 1, some junction connections 128 have saddles 132. FIG. 5 shows a saddle as it appears after installation. Each saddle 132 covers a respective flattened out portion 119 of the webbing. In the disclosed embodiment, only select junctions 128 have saddles 132. The saddles, where utilized, provide additional support to the rivet connection at that junction.

As seen in FIG. 1, the truss is symmetrical as it extends out from a center plane 160 to a first end 170 and to a second end 172. The last integral portions of webbing 206 are riveted to each truss at locations 210 and 214. An additional separate web member 208 is riveted at junction 212, and is received into an end cap 216.

In the disclosed embodiment, and as seen in FIG. 1, the saddles are located outwardly at four upper, and two lower positions. More specifically, the outermost upper saddles 218 are located at the first junction in from the last integral portion of webbing 206. The lower saddles 220 are located at the next junction inward, and the innermost upper saddles 222 are located at the junction inside of that. All of the junctions inside of saddles 218, 220, and 222 are simply riveted with side by side rivets 108.

Figure 6:
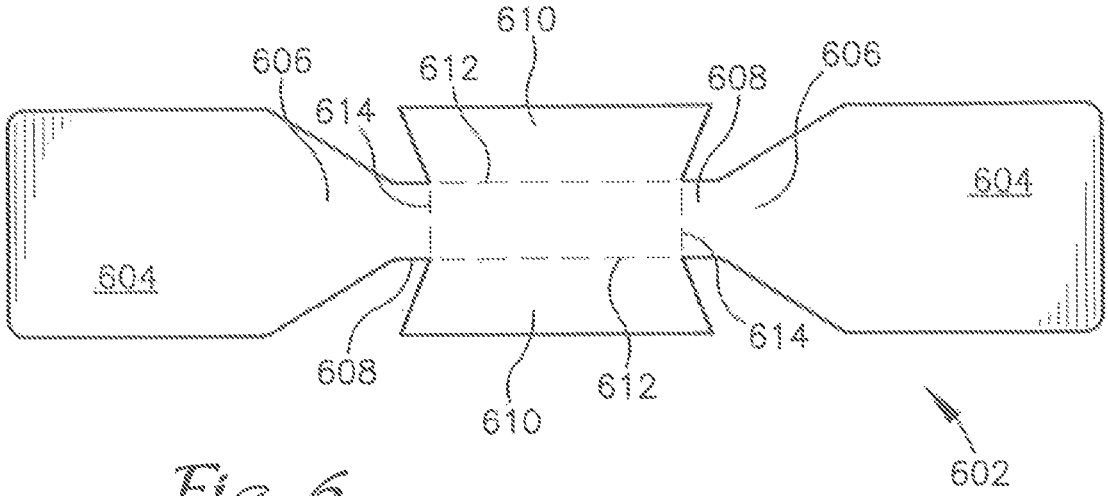
FIG. 6 is a view showing a blank which will be used to create a saddle.
Figure 7A:
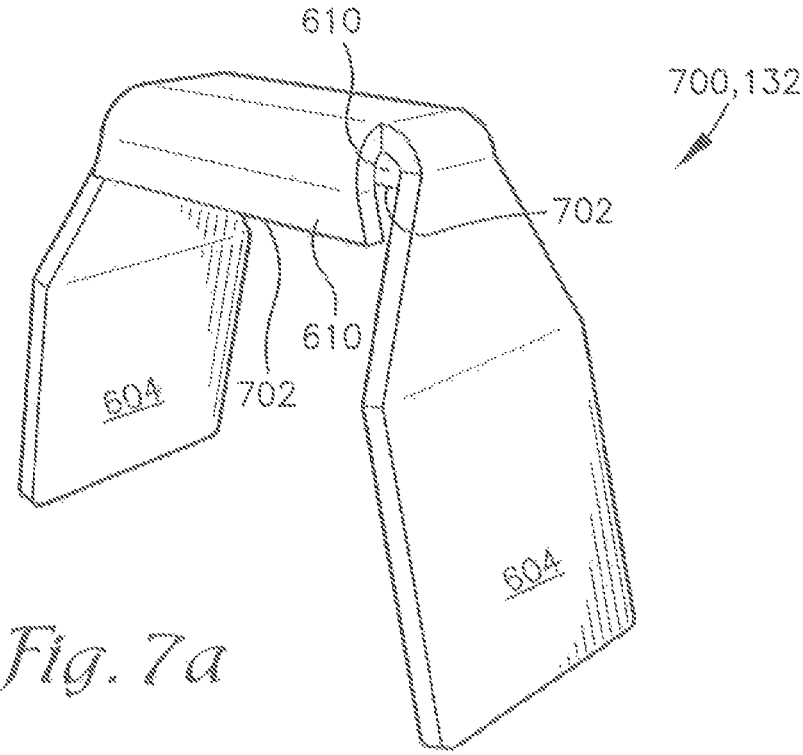
FIG. 7A is a perspective view showing the saddle post fabrication.
Figure 7B:
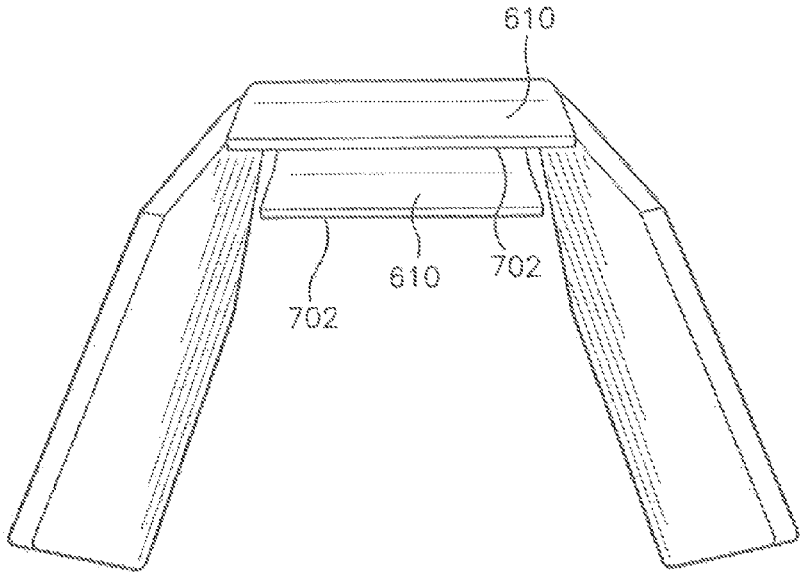
FIGS. 7B and 7C are perspective views showing a fabricated saddle post from below.
Figure 7C:
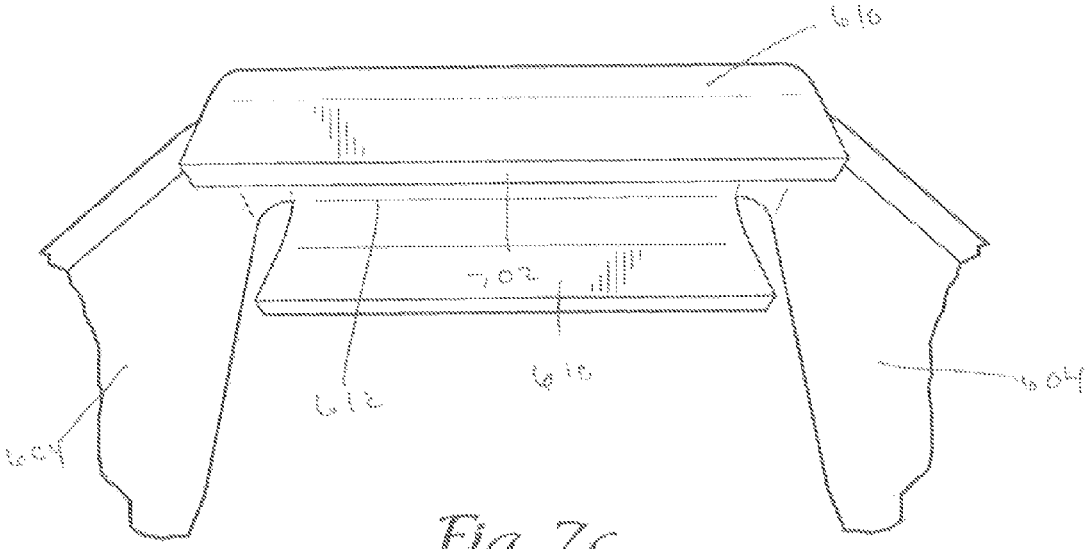

The saddles 132 are formed from blanks 602, an example of which can be seen in FIG. 6. The unprocessed blanks each include outer flanges 604, and then a tapered portion 606 terminates in a narrow middle 608. Emanating from the narrow middle 608, are a pair of outwardly tapered ears 610. These ears 610 are then bent downward at line 612 and then slightly inward to be positioned as shown in a finished saddle 700/132 shown in FIGS. 7A-C. Similarly, the outer flanges are bent downward about line 614 so that they extend downward and slightly outward as is also shown in FIG. 7A. Visible in FIG. 7B-C is that ears 610 remain symmetrical to one another after being bent into final form.

Figure 8:
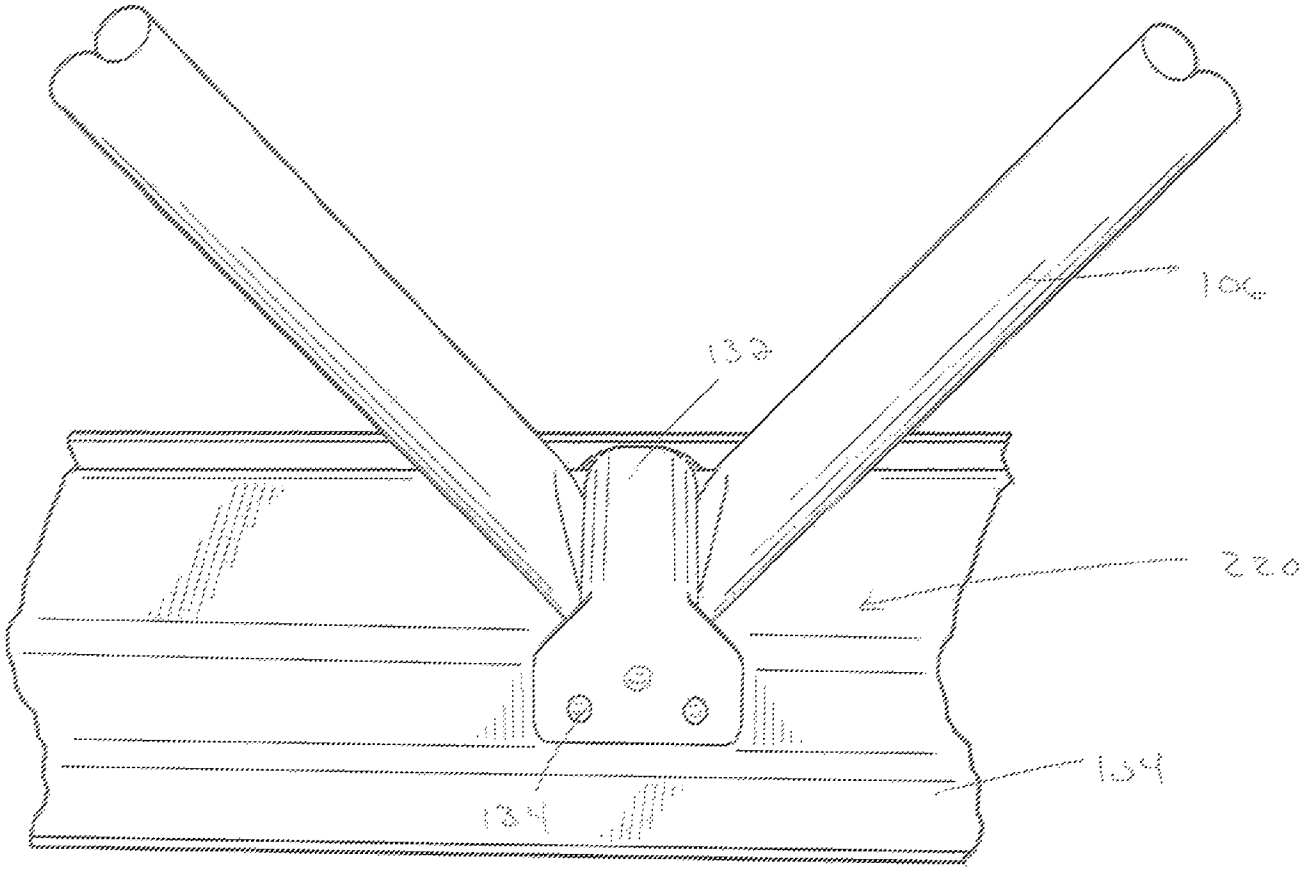
FIG. 8 shows an embodiment where the saddle has been installed on a chord section.

In order to install the saddles 132, they are placed at the desired junction locations, e.g., see FIG. 1, and then self-piercing rivets 134 are used to secure the flanges 604 to the side faces 123 (see FIG. 2) of the upper 102 and lower 104 chords. In one embodiment, two rivets 134 are used on each side of the chord as shown in FIG. 5. In other embodiments, three rivets 134 could be used as seen in FIG. 8. In yet other embodiments, other numbers of rivets 134 could be used. Although not shown in FIG. 5 or 8, it should be evident that rivets 134 are included in both flanges on each side of the chord.

The lower edges 702 of the saddles 132 (see FIGS. 7A-C), after the saddle is secured, will press down on the upward bend points on opposite sides of the flat portion 119 outside of the already-installed joint rivets 108. This provides additional reinforcement to the joint.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

I claim:

1. A truss comprising;

an upper and lower chord member each extending in generally the same longitudinal direction and in spaced apart relation;

the upper and lower chords each having a first end and a second end and a planar central panel with first and second side flanges extending therefrom;

a plurality of web member disposed between the upper and lower chord members, the web member having a first arm and a second arm, the first and second arms being separated by a flat crimp in the web member, the first arm having a first upper end and the second arm having a second upper end;

a first fastening system extending through the flat crimp and the lower chord thereby securing the web member to the lower chord, wherein the first fastening system comprises a steel first saddle member extending over the flat crimp and secured to the first and second side flanges, the saddle member further comprising a middle portion with first and second cars that are bent downwardly relative to the middle portion along separate bending lines at an angle of about 90 degrees;

a second fastening system extending through the upper chord and the first upper end securing the first upper end to the upper chord, wherein the second fastening system comprises a second saddle member identical to the first steel saddle member; and a third fastening system extending through the upper chord through the second upper end securing the second upper end to the upper chord, wherein the third fastening system comprises a third saddle member identical to the first steel saddle member.

2. The truss of claim 1, wherein the lower chord fastening system comprises at least one fastener inserted through a hole in the flat crimp and a hole in the lower chord.

3. The truss of claim 2, wherein the upper chord fastening system comprises at least one fastener inserted sequentially through a hole in the first upper end, a hole in an overlapping second upper end of an adjacent web member second arm and then a hole in the upper chord thereby securing the first arm of the web member and the second arm of the adjacent web member to the upper chord.

4. The truss of claim 3, wherein the fastener is at least one of 1) a rivet, 2) a bolt, and 3) a screw.

5. A truss comprising;

an upper and lower chord member each extending in generally the same longitudinal direction and in spaced apart relation;

the upper and lower chords each having a first end and a second end and a planar central panel with first and second side flanges extending therefrom;

a plurality of web member disposed between the upper and lower chord members, the web member having a first arm and a second arm, the first and second arms being separated by a flat crimp in the web member, the first arm having a first upper end and the second arm having a second upper end;

a first fastening system extending through the flat crimp and the lower chord thereby securing the web member to the lower chord;

a second fastening system extending through the upper chord and the first upper end securing the first upper end to the upper chord;

a third fastening system extending through the upper chord through the second upper end securing the second upper end to the upper chord, wherein the fastening systems proximate the first and second ends of the upper and lower chord further comprise a saddle member extending over the flat crimp, the saddle member being secured to the first and second side flanges of the respective upper and lower chords; wherein, the first, second and third fastening systems further comprising a saddle member with a middle portion and a first and second outer flange extending outwardly from a first and second longitudinal end of the middle portion, and extending downwardly from a first and second side of the middle portion are first and second ears that are bent downwardly along a bending line at an angle of about 75 degrees relative to the middle portion.

6. The truss of claim 5, wherein the fastening systems proximate the first and second ends of the upper chords comprise at least two fastening systems on the upper chord and at least one fastening system on the lower chord.

7. A metal frame building system comprising a plurality of primary frames, each of the frames having a top flange, the building system comprising: a plurality of metal trusses, the metal trusses further comprising;

an upper and lower chord member each extending in generally the same longitudinal direction and in spaced apart relation;

the upper and lower chords each having a first end and a second end and a planar central panel with first and second side flanges extending from the planar central panel;

a plurality of web members with first ends of the web members secured to the lower chord and second ends of the web members secured to the upper chord, the plurality of web member first ends and second ends in an overlapping relationship with adjacent web members;

a plurality of mechanical fastening systems for securing the plurality of web member first ends to the lower chord and a plurality of mechanical fastening systems for securing the plurality of web member second ends to the upper chord, the plurality of mechanical fastening systems further comprising a steel saddle member with a middle portion for overlapping the planar central panel and a first and second outer flange extending downwardly from a first and second longitudinal end of the middle portion, the first and second outer flanges secured to the first and second side flanges of the upper and lower chords and extending outwardly from a first and second lateral side of the middle portion are first and second ears that are bent downwardly along a bending line from the middle portion at an angle of about 90 degrees relative to the middle portion; wherein the plurality of metal trusses are adapted to be erected upon the building system frame and are secured to the top ends of the respective primary frames.

8. A method of assembling a truss comprising an upper and lower chord parallel in relation to one another, each chord having a planar central portion and oppositely disposed side faces extending outwardly from the planar central portion, the chords further having a plurality of holes therethrough for securing at least one web member to the upper and lower chords, the web member having a first arm with a first distal end and a second arm with a second distal end, the first and second ends each having a crimped flat portion, the first and second arms joined at a flat crimped midsection, the method comprising the steps of:

a) separating the upper and lower chord by a distance sufficient to position the at least one web member between the upper and lower chords;

b) inserting at least one fastener through each of the crimped flat portions of the web members and through the planar central portion of the upper and lower chords;

c) positioning a first upwardly extending ear of the saddle member adjacent the first arm of the first web member and a second upwardly extending ear of the saddle member adjacent the overlapping second arm of an adjacent second web member at the upper chord;

d) positioning a first downwardly extending ear of the saddle member adjacent the first arm at the flat crimped midsection and positioning a second downwardly extending ear of the saddle member adjacent the second arm of the flat crimped midsection of the lower chord;

e) securing a first and second outer flange of at least one saddle member to the side faces of the upper chord; and f) securing the first and second side flanges of at least one saddle member to the side faces of the lower chord.

9. The method of claim 8, wherein the upper and lower saddle member are comprised of a middle portion with first and second outer flanges extending outwardly from the middle portion with both the first and second flanges bent downwardly along a bending line.

10. The method of claim 8, wherein the securing at least one saddle member to the side faces of the upper chord step comprises passing at least one fastener through each of the first and second outer flanges of the saddle member and through the oppositely disposed side faces of the chord.

11. The method of claim 8, wherein the securing at least one saddle member to the side faces of the lower chord step comprises passing at least one fastener through each of the first and second outer flanges of the saddle member and through the oppositely disposed side faces of the chord.

* * * * *